United States Patent [19]

Wenz et al.

[11] Patent Number: 4,572,093

[45] Date of Patent: Feb. 25, 1986

[54] LUBRICATING SYSTEM FOR SEWING MACHINES

[75] Inventors: Herbert Wenz; Dietmar Becker, both of Kaiserslautern, Fed. Rep. of Germany

[73] Assignee: Pfaff Industriemaschinen GmbH, Fed. Rep. of Germany

[21] Appl. No.: 570,499

[22] Filed: Jan. 13, 1984

[30] Foreign Application Priority Data

Feb. 24, 1983 [DE] Fed. Rep. of Germany ..... 3306414

[51] Int. Cl.[4] ..... D05B 71/00

[52] U.S. Cl. ..... 112/256; 184/102; 308/243

[58] Field of Search ..... 112/256; 184/64, 102; 308/243

[56] References Cited

U.S. PATENT DOCUMENTS

| | | | |
|---|---|---|---|
| 1,596,574 | 8/1926 | Becker | 308/243 |
| 2,047,730 | 7/1936 | Fleckenstein | 112/256 |
| 2,936,202 | 5/1960 | Barber | 308/243 |
| 3,418,955 | 12/1968 | Attwood et al. | 112/256 |
| 4,099,805 | 7/1978 | Gainer et al. | 308/243 X |

FOREIGN PATENT DOCUMENTS

| | | | |
|---|---|---|---|
| 593888 | 2/1932 | Fed. Rep. of Germany . | |
| 0138686 | 11/1979 | Fed. Rep. of Germany | 112/256 |
| 0151193 | 10/1981 | Fed. Rep. of Germany | 112/256 |

*Primary Examiner*—Werner H. Schroeder
*Assistant Examiner*—Andrew M. Falik
*Attorney, Agent, or Firm*—McGlew and Tuttle

[57] ABSTRACT

A lubricating system for sewing machines is produced with the sewing machine running by cutting a predetermined amount of cotton fibers into small lengths and blowing the fiber lengths into the sewing machine housing. As the fibers fill the housing a felt cushion conformable to the paths of motion of the parts of the mechanism is produced. The felt cushion is supplied with oil through a wick.

11 Claims, 2 Drawing Figures

LUBRICATING SYSTEM FOR SEWING MACHINES

FIELD AND BACKGROUND OF THE INVENTION

This invention relates in general to sewing machines and in particular to a new and useful lubricating system and method of establishing a system for lubricating operating parts of a device such as a sewing machine.

In sewing machines in which, for reasons of design, space or economy, the bearing points are embodied not as encapsulated antifriction bearings requiring no maintenance, but as plain bearings, the necessity arises to supply these partly linearly or circularly moving bearings with a lubricant in sufficient amounts. Because the housing is necessarily provided with openings, for example for the take-up lever or a horizontal needle bar, excessive amounts of lubricant in the bearings must be avoided, to prevent lubricant particles from being propelled by the oscillating or rotating parts out of the housing and thus soiling the work.

German Pat. No. 59 3 888 shows a conventional lubricating system using wicks in a number corresponding to the number of bearings or bearing points to be lubricated and having one end in contact with the bearing or the respective guiding surface, and their other end dipped into a common lubricating vessel. To ensure that the moving bearing parts contact the wick ends in the desired manner without tearing the wicks loose, all the wicks must be carefully secured and also exactly adjusted in a tiresome and time consuming way.

It is known from German Pat. No. 634 710 to supply two bearing sleeves of a needle bar link in the head of a sewing machine through a common lubricant carrier. For this purpose, a felt lining connecting to a lubricant supply is secured to a portion of the inside surface of the head. In the zone of the circularly moving bearing sleeve, the head is concentrical with this circular path of motion of the sleeve. The felt lining is secured in this zone and therefore extends concentrically of the path of motion of the bearing sleeve. Thus, during a part of its rotary motion, the bearing sleeve brushes against the felt and takes up some of the lubricant. In the lower dead center position of the needle bar, the linearly moving bearing sleeve contacts the lower portion of the felt lining and is thus lubricated.

In this prior art design, with the machine head conformable to the respective path of motion, only two moving bearing areas are lubricated through a common lubricant carrier. An additional, separate lubricant carrier is needed for a third moving bearing, namely the smaller radius bearing sleeve of the take-up lever.

East German Pat. No. 01 38 686 discloses a lubricating system for sewing machines wherein all the cavities in a bearing area are filled with a lubricant carrier of a soft polyurethane foam. This lubricating system is applicable to hollow shafts having cross bores which lead to bearing points. With bearing points which rotate about an axis in spaced relationship therewith, or which move linearly, a lubricant supply from the interior is very costly. Such a system is therefore unsuitable for lubricating areas located within the head of sewing machine.

SUMMARY OF THE INVENTION

The invention is directed to a method in which a lubricating system is established by forming a lubricant carrier which is tangent to the path of motion of a plurality of bearing points. Fiber cuts are introduced into the machine housing to fill a housing of any shape. The filled material will mat together into a felt cushion which fits the walls of the housing so that the cushion is positively held in place. Since the fiber cuts are introduced while the sewing machine is running, the moving parts of the mechanism produce within the felt cushion individual and communicating cavities bounding the paths of motion. The boundaries of these cavities are in steady contact with the moving parts and are thus capable of continually transferring lubricant to the bearing points. Since the cavities are produced already during the formation of the felt cushion and are conformable to the path of motion of the parts, and the felt cushion is backed up on all sides by the housing walls, there is no chance that the rotary or oscillating parts would entrain or deform the felt cushion, even at high speeds of the sewing machine. The inventive method is therefore particularly suited for rapidly establishing a lubricating system supplying all the bearing points in the head of a sewing machine. Since the fiber cuts form a felt cushion conformable to the housing and closely surrounding the paths of motion of any number of parts moving in rotary or oscillatory motion, sewing machines of different design may easily and in any sequence be provided with such a lubricating system.

Another advantage of this lubricating system is that the felt cushion filling the head prevents dust of dressing agents, produced during a sewing operation and whirling around, from penetrating inside where it would combine with the lubricant and act as an abrasive paste.

The provision of sprinkling the inside surface of the housing prior to the introduction of fiber cuts accelerates the formation of a felt cushion fairly stable in shape, since the buildup and condensation of the cushion takes place from the housing walls to the center.

According to another aspect of the invention fiber cuts are blown into the housing and are produced by continuously cutting a cotton wick. Cotton fibers are particularly suitable for producing a felt cushion. It is advantageous in this connection to employ commercial wick cords commonly used for making lubrication wicks, and to chip them to fiber cuts just prior to producing the felt cushion, and then immediately blow the fiber cuts into the housing. Storage and handling of the felt cushion material is thereby simplified.

The provision of connecting the felt cushion to a lubricant metering device makes sure that the felt cushion will be supplied with lubricant to a satisfactory extent without exceeding this supply.

The feature of building up a felt cushion around supporting elements of the machine additionally stabilizes the felt cushion.

Advantageously the invention provides a device for feeding cut fibers to the housing of the machine to be lubricated. The device advantageously includes a feed pipe into the interior of which is supplied a compressed air supply so as to direct individual fibers which are cut from a continuous length through a feed pipe and a discharge nozzle and into the housing. The discharge nozzle advantageously comprises a mouthpiece establishing connections with a closable aperture of the housing of the machine to be lubricated. The device for establishing the system includes a feed pipe for advancing a continuous wick of a fibrous material such as a cotton wick or cord.

Accordingly it is an object of the invention to provide an improved method for establishing a lubricating system in a housing containing operating parts such as a sewing machine housing.

A further object of the invention is to provide a lubricating system particularly for the operating spaces of the housing of a sewing machine in which the driving members of the sewing machine are moved and which comprises a felt cushion formed around the moving driving member in a pattern surrounding the paths of these movements.

A further object of the invention is to provide a lubricating system which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 1, 2:
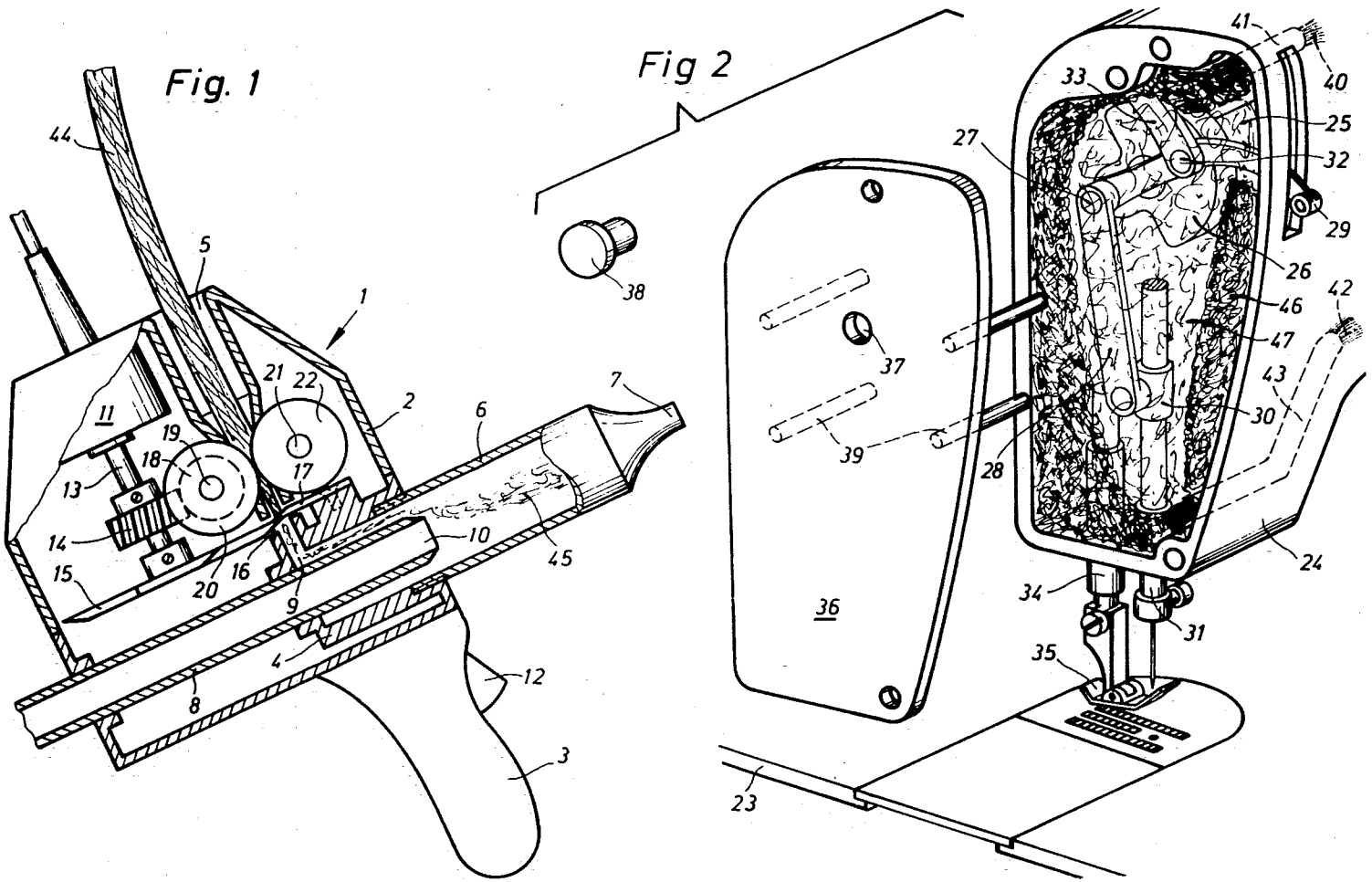
FIG. 1 is a partial side elevational and sectional view of the device for cutting the fibers and blowing the fibers into a housing and to establish a lubricating system in the housing.
FIG. 2 is an exploded partial side elevational view of a felt cushion formed in a sewing machine housing.

Referring to the drawings in particular the invention embodied therein comprises a lubricating system particularly for the operating spaces in the housing or head portion 24 of a sewing machine in which the sewing machine driving members including a rotating cam plate 26, reciprocating presser foot bar 34 and needle bar 31 are movable. The system comprises a felt cushion 46 formed around the moving driving members in a pattern surrounding the paths of movement of the members. The felt cushion is provided with a sprinkle of liquid lubricant.

In accordance with the method of the invention, the lubricating system is formed with the use of a cut fiber forming a feeding device has a nozzle discharge 7 for discharging through an opening 37 of the sewing machine into the operating spaces of the housing. In accordance with the method of the invention the fibers are cut from a continuous length or width 44 so as to form fiber cuts 45 which are directed by compressed air from a compressed air line 8 through the nozzle discharge 7 and into a small opening 37 during the operation of the machine. The felt cushion 46 is advantageously then sprayed with lubricant and in addition the lubricant is supplied from a wick 40 and another wick 42.

A device 1 comprises a casing 2 of two parts, a handle 3, a tubular extension 4 provided inside the casing, and a guide channel 5 narrowing inwardly. Secured to tubular extension 4 is a feed pipe 6 having its outside end formed to a mouthpiece or discharge nozzle 7. The end of a compressed air line 8 is secured in tubular extension 4 and protrudes into feed pipe 6. In connection with a cross bore 9 provided in tubular extension 4, the end of line 8 within extension 4 and feed pipe 6 forms an injection nozzle 10.

Device 1 further comprises an electric motor 11 which can be actuated by means of a trigger or switch 12 provided on handle 3. The shaft 13 of motor 11 carries a helical gear and a cutting disc 15 including several blades. Cutting disc 15 projects into a gap 16 provided between tubular extension 4 and guide channel 5, and cooperates with a counterblade 17 which is secured to extension 4. Helical gear 14 meshes with a helical gear 18 which is secured to a shaft 19. Further secured to shaft 19 is a friction wheel 20 cooperating with another friction wheel 22 which is mounted for free rotation on a pin 21.

FIG. 2 shows a portion of the bedplate 23 and the head 24 of a sewing machine. One end of the arm shaft 25 projects into head 24 and carries a cam plate 26 secured thereto. The needle bar link 28 and the take-up lever 29 are mounted on a pin 27 of cam plate 26. Needle bar link 28 is connected through a clamp sleeve 30 to the needle bar 31 which is mounted in head 24. Take-up lever 29 is connected through a pin 32 to a link 33. Further mounted in head 24 is the presser foot bar 34 carrying the presser foot 25. The front side of head 24 is closed by a cover plate 36. Cover plate 36 is provided with a bore which corresponds to the diameter of mouthpiece 7 and can be closed with a plug 38. To the inside of cover plate 36, a plurality of pins 39 is secured which project into head 24 at locations outside the path of motion of the moving parts 25 to 33 of the mechanism.

A wick 40 is received in a tube 41 to protrude by its unraveled end portion into the upper part of the interior of head 24. The other end of wick 40 reaches into a lubricant supply vessel (not shown) which is similar in design to that disclosed in German utility model No. 19 02 333 and serves at the same time as a lubricant metering device. An unraveled end portion of another wick 42 received in a tube 43 protrudes into the lower part of the interior of head 24. In a manner shown in German Pat. No. 964,559, wick 42 reaches by its other end at a lower level into the base (not shown) of the sewing machine, whereby the lubricant accumulating in the lower zone of head 24 is transferred into a lubricant collector provided beneath bed plate 23.

During the assemblage of the sewing machine, prior to securing cover plate 36, the inside surface of head 24 and the parts 25–33 of the mechanism accommodated within are sprinkled with oil by spraying an oil mist. Upon securing cover plate 36, device 1 is made ready by introducing a cotton wick 44 into guide channel 5. Line 8 is then pressurized with compressed air, and electric motor 11 is switched on, so that friction wheels 20, 22 start to feed wick 44 to rotary cutting disc 15 by which the wick is successively chipped to fiber cuts 45 having a length of about 3 mm, which fiber cuts are then entrained at injection nozzle 10, by the air flowing through line 8, and blown through feed pipe 6, mouthpiece 7, and bore 37 into head 24, while the sewing machine is running at a speed of about 200 rpm.

Fiber cuts 45 impinge on rotating and oscillating parts 25–33 with the result that a few of the fiber cuts cling to the moving parts, while the majority of them is thrown onto the walls of head 24. These fiber cuts 45 tangle and mat to form a loose felt cushion 46 which builds up from the walls of head 24 inwardly and gradually fills the entire head 24 while growing denser and denser. Since fiber cuts 45 are blown in while the sewing machine is running, moving parts 25–33 of the mechanism produce within felt cushion 46 individual or communicating cavities 47 forming boundaries of the respective paths of motion. The amount of fiber cuts 45 needed for filling head 24 is metered by providing a corresponding length of wick 44.

After fiber cuts 45 are blown in, oil is sprayed by any suitable means (not shown) into head 24 through a filling and lubricant bore 37, to sprinkle felt cushion 45 with oil. Bore 37 is then closed with plug 38. With the sewing machine running, this basic sprinkling of felt cushion 46 is followed by further oiling through wick 40 which protrudes into cushion 46.

The boundaries of cavities 47 formed in felt cushion 46 are in continual contact with moving parts 25–33 so that they are capable of steadily delivering oil to the bearing points of the moving parts. Since cavities 47 have been produced already during the buildup of felt cushion 46 and are therefore conformable to the paths of motion of parts 25–33, and since felt cushion 46 is backed up by the walls of head 24 on all sides, thus positiviely retained, and pins 39 further ensure a stable position of cushion 46, no risk is run that moving parts 25–33 would entrain or deform felt cushion 46, not even at high speeds of the sewing machine.

While specific embodiments of the invention have been shown and described in detail to illustrate the application of the principles of the invention, it will be understood that the invention may be embodied otherwise without departing from such principles.

We claim:

1. A method of establishing a lubricating system for operating machines, particularly in sewing machines, for lubricating bearing points within the sewing machine housing, comprising directing, while the sewing machine is running, a predetermined amount of fiber cuts of a material having satisfactory absorbtive capacity and matting property into the housing to cause the formation of a felt cushion which becomes positively held in the housing and conforms to the paths of motion of the moving parts, and sprinkling the fiber cuts with oil.

2. A method according to claim 1, wherein the fibers are first cut into small lengths from a continuous length of fibrous material and they are introduced into the housing by blowing.

3. A method according to claim 2, including connecting a lubricant supply to a metering device to meter the amount of lubricant supplied to the felt cushion.

4. A method of establishing a lubricating system for operating machines, particularly in sewing machines, for lubricating bearing points within the sewing machine housing, comprising directing, while the sewing machine is running, a predetermined amount of fiber cuts of a material having satisfactorily absorptive capacity and matting property into the housing to cause the formation of a felt cushion which becomes positively held in the housing and conforms to the paths of motion of the moving parts, and sprinkling the fiber cuts with oil, including lubricating the interior of the housing before directing the fiber cuts into the housing.

5. A method of establishing a lubricating system for operating machines, particularly in sewing machines, for lubricating bearing points within the sewing machine housing, comprising directing, while the sewing machine is running, a predetermined amount of fiber cuts of a material having satisfactory absorptive capacity and matting property into the housing to cause the formation of a felt cushion which becomes positively held in the housing and conforms to the paths of motion of the moving parts, and sprinkling the fiber cuts with oil, the felt cushion being built up around supporting elements which protrude into the interor of the housing.

6. A device for facilitating the lubricating of the interior of a sewing machine having a sewing machine housing with operating mechanism therein and a housing wall with a small lubricating opening, comprising a feedpipe, means connecting a compressed air supply to the interior of said feedpipe, said feedpipe having a discharge nozzle of a size to fit into the small opening of the sewing machine housing, and feed means for supplying cut pieces of lubricant absorbing material into said feedpipe for discharge with the air into the sewing machine housing.

7. A device according to claim 6, wherein said feed means includes a supply of a continuous length of fibrous material, means for advancing the fibrous material around said feedpipe, cutting means associated with said feed means for cutting the lengths into separate fiber cuts.

8. A device according to claim 7, including a housing containing said material advancing means and said cutting means, said feedpipe extending through said housing and including a compressed air pipe extendng through said housing into said feedpipe.

9. A lubricating system particularly for operating spaces of a housing of a sewing machine in which the sewing machine drive members are moved, comprising a sewing machine having a reciprocating needle bar for a sewing needle and for movement in said housing, a drive shaft for said needle rotatably mounted in said housing, movable drive members in said housing connected between said drive shaft and said needle bar, the felt cushion formed around said movable drive members in a pattern surrounding the paths of movement of said members, means for supplying lubricants to said felt cushion, and a cover for said housing having a small size opening into which the felt cushion material is blown.

10. A lubricating system according to claim 9, wherein said means for supplying the lubricant comprises, a lubricating source and at least one wick extending from said lubricating source into said housing.

11. A sewing machine housing having a rotatable shaft for driving a reciprocating needle with movable parts being located in the housing between the shaft and the needle the improvement comprising a felt cushion formed around the movable parts forming a coherent mass adapted to hold a lubricant therein and substantially completely filling the housing, and a means for supplying lubricant to said coherent mass, said mass being shaped by the movement of the parts.

* * * * *